United States Patent [19]

Cunningham et al.

[11] 4,052,016

[45] Oct. 4, 1977

[54] METHOD AND APPARATUS FOR REMOVING WOUND PACKAGES FROM A WINDING MACHINE

[75] Inventors: Cecil R. Cunningham, Aiken, S.C.; Alex P. Symborski, Newark, OH

[73] Assignee: Owens-Corning Fiberglas Corporation, Toledo, Ohio

[21] Appl. No.: 612,399

[22] Filed: Sept. 11, 1975

[51] Int. Cl.[2] ..... B65H 54/02

[52] U.S. Cl. ..... 242/18 G; 242/18 A; 242/41

[58] Field of Search ..... 242/18 G, 41, 18 R, 242/18 A, 81, 18 DD

[56] References Cited

U.S. PATENT DOCUMENTS

| | | | |
|---|---|---|---|
| 2,385,949 | 10/1945 | Siegenthaler | 242/41 X |
| 3,512,725 | 5/1970 | Smith et al. | 242/18 G |
| 3,693,897 | 9/1972 | Davidson | 242/41 |
| 3,762,661 | 10/1973 | Lucke | 242/41 |
| 3,807,647 | 4/1974 | Miller | 242/18 DD |
| 3,908,918 | 9/1975 | Bergstrom | 242/41 |

FOREIGN PATENT DOCUMENTS

| | | | |
|---|---|---|---|
| 339,007 | 4/1936 | Italy | 242/41 |
| 870,402 | 6/1961 | United Kingdom | 242/18 R |

*Primary Examiner*—Harry N. Haroian
*Attorney, Agent, or Firm*—Ronald C. Hudgens; Harry O. Ernsberger; Gregory Dziegielewski

[57] ABSTRACT

The disclosure embraces a method of and apparatus for effecting removal of at least one wound package of linear material, particularly a package of a strand of glass fibers, from a winding collet or mandrel of a winding machine at the completion of a winding cycle.

9 Claims, 11 Drawing Figures

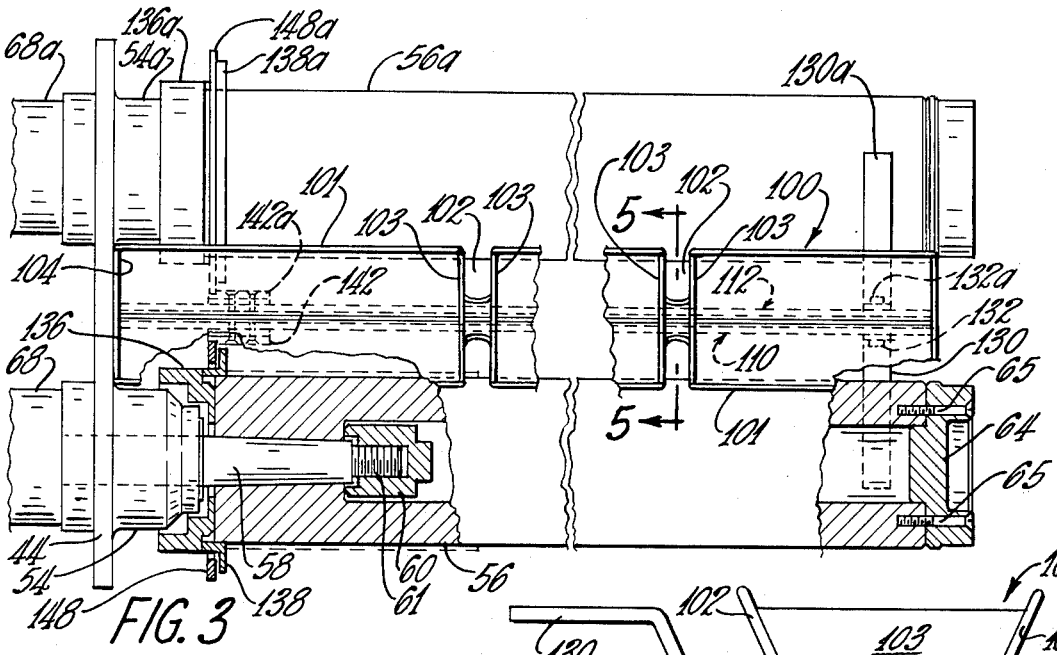
FIG. 3
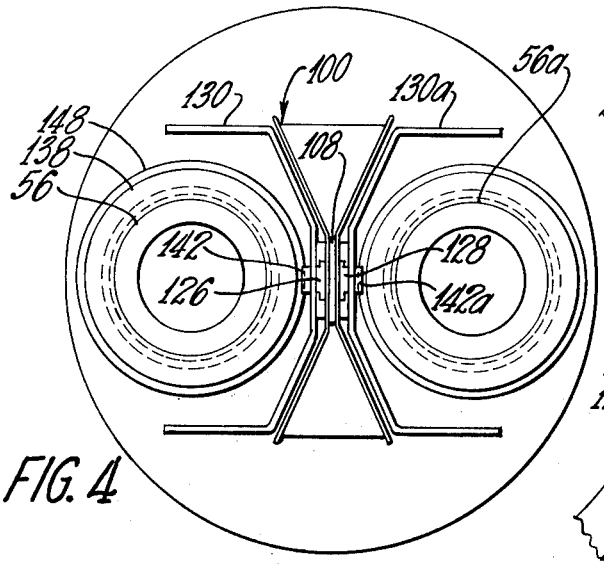
FIG. 4
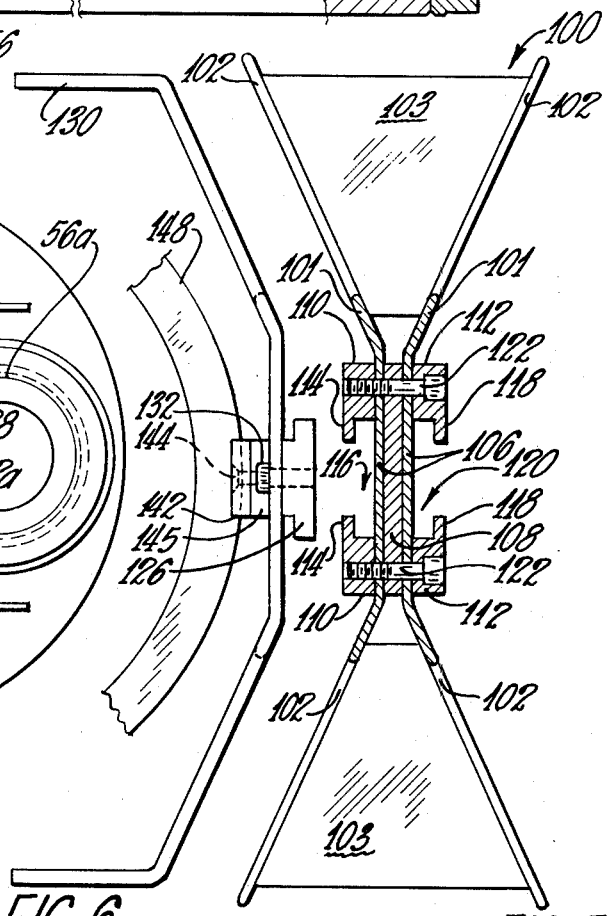
FIG. 6
FIG. 5
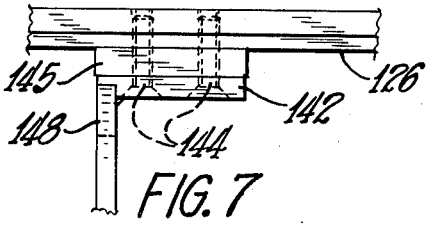
FIG. 7

METHOD AND APPARATUS FOR REMOVING WOUND PACKAGES FROM A WINDING MACHINE

The invention relates to a method and apparatus in association with a winding machine for effecting removal of one or more wound packages of linear material, such as packages of strands of glass fibers, from a winding collet or mandrel at the completion of a winding cycle wherein the strands are wound on forming tubes or collectors supported on the collet or mandrel in end-to-end relation.

It has been conventional practice particularly in forming and packaging fibers or filaments attenuated from streams of heat-softened glass to wind strands of the fibers or filaments upon two rotating forming tubes, collectors or sleeves mounted upon a collet into two packages. At the completion of the winding of the packages, the machine operator removes the packages by hand from the collet and telescopes two strand-free or empty forming tubes or collectors onto the collet preparatory to a succeeding winding cycle. An arrangement of this character for winding two packages simultaneously on a single collet is shown in the Smith et al U.S. Pat. No. 3,512,725.

In order to increase production and reduce the cost of forming and packaging strands of glass fibers or filaments, longer collets are being used and three or more forming tubes or collectors are mounted on a collet in end-to-end abutting relation, a strand of fibers or filaments attenuated from glass streams being wound on each of the forming tubes or collectors into a package.

Conventional forming tubes are usually of a length of eleven inches or more and when more than two forming tubes are mounted on a collet in end-to-end abutting relation an operator encounters difficulties in removing the forming tubes bearing completed packages from the collet. Such condition is aggravated because it is usual for several winding machines to be arranged in a row with the winding machines in closely spaced, side-by-side relation, rendering access difficult for an operator to remove the rearmost packages from the long collet.

The invention pertains to the provision of a method of removing or stripping completed packages of strand or linear material from a collet or mandrel of a winding machine involving engaging a member with a rearmost forming tube bearing a package of strand and moving the member relative to the collet to strip or remove the completed packages from the collet.

Another object of the invention is the provision of an apparatus or means embodied in or associated with a winding machine adapted for winding several strands into a plurality of packages on forming tubes in end-to-end relation on a rotatable support or collet including a member engageable with the rearmost forming tube, and relatively movable means associated with the member for stripping or removing the forming tubes bearing the completed packages from the rotatable support or collet.

Another object of the invention embraces a means associated with a winding machine rendered effective upon the completion of the winding of a plurality of packages of strand for automatically stripping the packages from a rotatable support or collet.

A further object of the invention resides in the provision of an annular member loosely mounted upon a rotatable support of a winding machine on which forming tubes are mounted and strands wound thereon to form packages in association with means for moving the annular member lengthwise of the support for stripping the forming tubes bearing the packages of strand from the support at the completion of a winding cycle.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which:

FIG. 3 is a plan view, partly in section, of the winding collets and one form of package removing apparatus associated therewith;

FIG. 4 is an end view of the collets and package removing apparatus shown in FIG. 3;

FIG. 5 is an enlarged detail sectional view taken substantially on the line 5—5 of FIG. 3 excluding certain components of the package removing apparatus;

FIG. 6 is an enlarged elevational view of the package removing means shown in FIG. 4;

FIG. 7 is a fragmentary plan view of a component of the package removing means;

Figure 1:
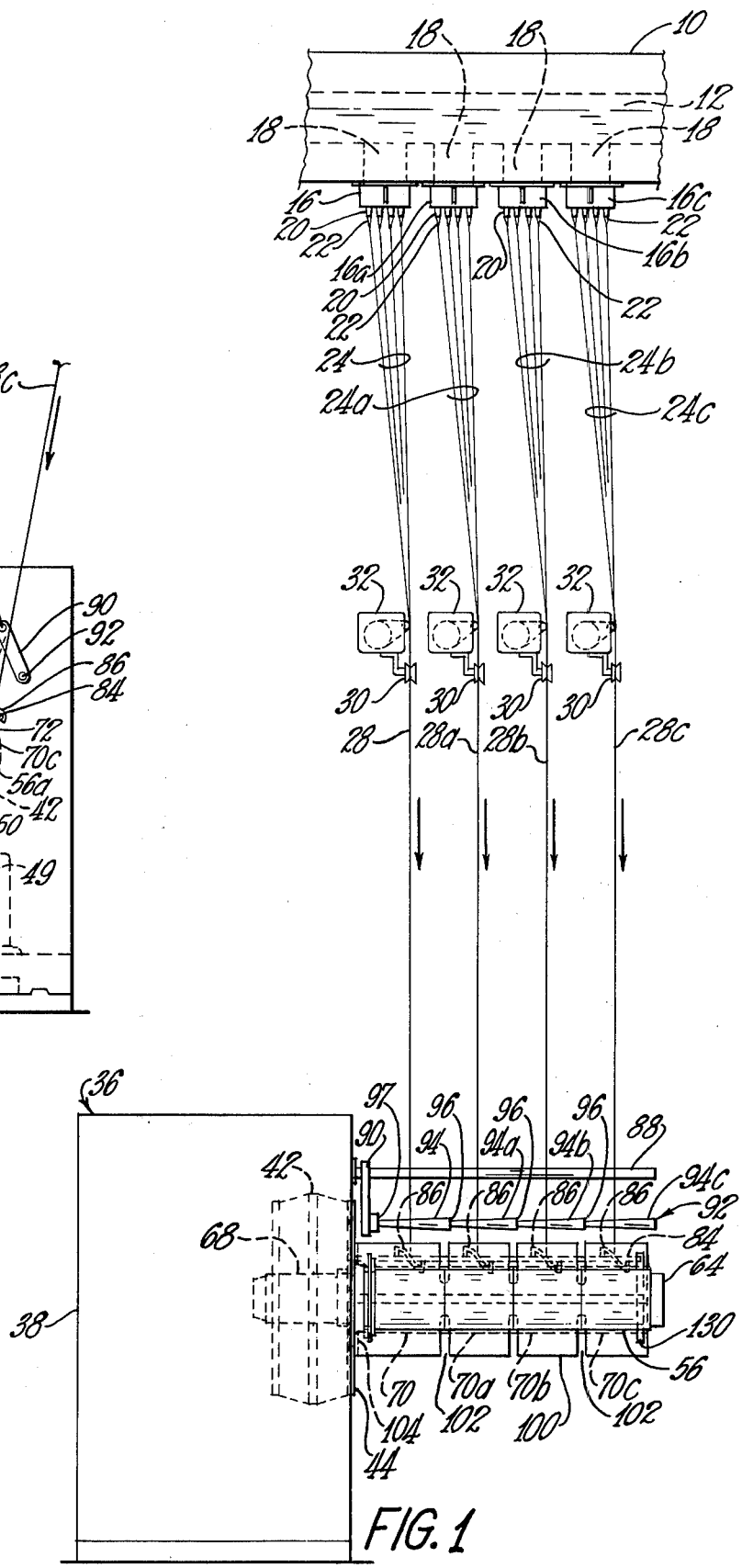
FIG. 1 is a side elevational view illustrating a form of automatic winding apparatus or machine embodying the invention.

Referring to the drawings in detail and initially to FIG. 1, there is illustrated a portion of a means or forehearth 10 having a channel 12 containing heat-softened, fiber-forming mineral material, such as glass, the forehearth 10 being connected with a melting furnace or facility (not shown) in which the mineral material or glass batch is reduced to a heat-softened or molten condition.

Spaced lengthwise along the forehearth 10 is a plurality of stream feeders or bushings, there being four stream feeders 16, 16*a*, 16*b* and 16*c* shown in FIG. 1. Each of the stream feeders receives heat-softened glass from the channel 12 through a passage 18 in the floor of the forehearth, there being a separate passage 18 for each feeder. Each of the stream feeders is provided with a plurality of depending projections 20, the projctions having orifices through which flow streams 22 of glass, the groups of streams being attenuated to fibers or filaments by winding strands of the fibers or filaments into packages on a winding machine.

The filaments attenuated from each group of streams are indicated at 24, 24*a*, 24*b* and 24*c*. The filaments of the respective groups are converged into strands 28, 28*a*, 28*b* and 28*c* by gathering shoes 30, there being a gathering shoe for each group of filaments. An individual size applicator 32 is provided for each group of filaments for applying size or other coating material to the filaments of each group.

Figure 2:
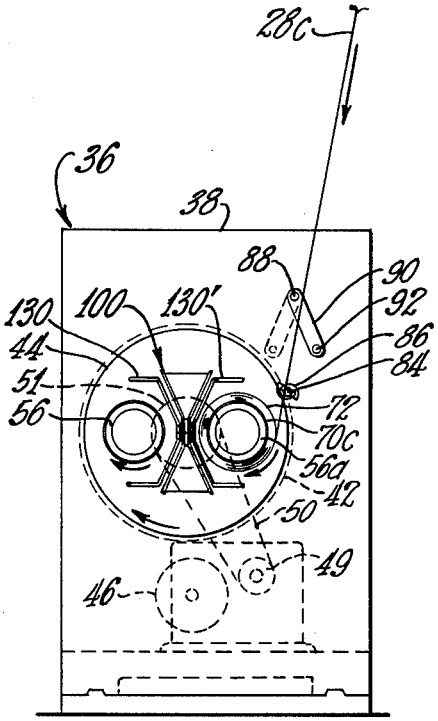
FIG. 2 is a front elevational view of the winding apparatus illustrated in FIG. 1.

The winding machine 36, schematically illustrated in FIGS. 1 and 2, is of the automatic type of the general character disclosed in Smith U.S. Pat. No. 3,109,602 but having two winding collets in lieu of three winding collets illustrated in the patent. The winding machine 36 is inclusive of a frame or housing 38 which encloses and supports various components of the winding apparatus. Suitably journaled within the housing 38 is an indexible and rotatable turret or head construction 42.

The turret construction 42 is inclusive of a circular member or plate 44 disposed exteriorly of the housing 38. The turret 42 is adapted to be rotated or indexed by a motor 46 through transmission mechanism driving a sprocket 49 connected by a driving chain 50 with a sprocket 51 secured to the turret construction 42. As shown in FIG. 3, the member 44 is provided with two hollow boss portions 54 and **54*a* enclosing journal bearings for rotatably mounting hollow winding collets or mandrels 56 and 56*a***.

The collet mounting arrangement is illustrated in FIG. 3 and includes a spindle 58 mounted in bearings in the boss portion 54, the collet 56 having a tapered bore receiving the spindle 58. The collet is secured on the spindle 58 by a nut 60 threaded onto a tenon 61 on the spindle 58. An end cap or closure 64 is secured on the distal end of the collet by screws 65. The collet 56 is adapted to be rotated by a motor 68 in packaging strands of fibers or filaments.

The collet construction **56*a* is of the same construction as collet 56 and its supporting spindle is mounted in bearings contained within the hollow boss portion 54*a*. The collet 56*a* is adapted to be rotated by a motor 68*a*. The electrically energizable motors 68 and 68*a* for rotating the collets are enclosed within the turret construction 42**.

As shown in FIG. 2, the collet **56*a* is disposed in package winding position at a winding station, and the collet 56 is disposed in a standby or package removing position or station, the collets being spaced apart 180° circumferentially of the turret member or plate 44**.

The turret indexing motor 46, the controls therefor, the collet driving motors 68 and **68*a* and the controls therefor are of the character disclosed in Smith U.S. Pat. No. 3,109,602. The collet driving motors 68 and** 68*a* are of the variable speed type and are controlled whereby the collet at the winding station is progressively reduced in speed as the strand package increases in size in order to maintain attenuation of the filaments at a constant speed whereby the formed filaments are of substantially uniform diameters.

The purpose of automatically indexing the collets is to successively move completed strand packages away from the winding station and move the other collet, bearing empty packaging collectors or forming tubes, into package forming position at the winding station. Each of the collets or mandrels 56 and **56*a*** is of a length to receive and support three or more strand collectors, sleeves or forming tubes in aligned end-to-end relation and upon which the strands of fibers or filaments are wound into packages.

As indicated in broken lines in FIG. 1, the collet **56*a* supports four collectors or forming tubes 70, 70*a*, 70*b* and 70*c* in end-to-end abutting relation on which packages of strand are being wound with the collet 56*a* in strand winding position at the winding station. As shown in FIG. 2, a package 72 of strand 28*c* is being formed on the forming tube 70*c*, and identical packages of the other strands are concomitantly formed on the other forming tubes on the collet 56*a***.

The collet or mandrel constructions 56 and **56*a* are of the so-called collapsible type. The forming tubes or collectors 70, 70*a*, 70*b* and 70*c* are of thin-walled construction of plastic or resinous material. The collapsible collets 56 and 56*a*** may be of the type shown in Cunningham et al U.S. Pat. No. 3,687,381 wherein a core is equipped with circumferentially-arranged fingers under radial spring pressure engaging the interior surfaces of the forming tubes on the collet. Centrifugal forces of rotation of the collet during winding exert substantial outwardly acting forces preventing appreciable constriction of the forming tube bearing a wound package of strand so that it may be readily removed or stripped from the collapsible collet.

The winding machine is inclusive of a strand traverse means for distributing the strands lengthwise of the package and for oscillating the strands during traverse lengthwise of the packages in order to effect crossing of individual convolutions or wraps of strands as they are collected on the packages, this being conventional in winding packages of strands of glass fibers or filaments. A shaft 84 disposed lengthwise of the mandrels is rotated and reciprocated by means (not shown) contained within the housing 38.

Mounted upon the shaft 84 and rotatable and reciprocable therewith are strand oscillators or guides 86 preferably of the character shown in the patent to Beach U.S. Pat. No. 2,391,870 for oscillating the strands and traversing the strands lengthwise in forming the packages, there being a strand oscillator 86 for each of the strands.

The arrangement illustrated in FIGS. 1 and 2 includes means for controlling the strands during automatic transfer of the strands from the completed packages onto empty collectors or forming tubes on the other collet during indexing movement of the turret 42. The strands are disengaged from the oscillators 86 at the completion of the packages and are moved or diverted to the end regions of the strand packages just prior to transfer of the strands onto the empty forming tubes mounted by the other winding collet.

The strand control means is inclusive of a shaft 88 extending into the winding maching housing 38 and which is arranged to be reciprocated by means (not shown) in timed relation with the indexing of the collet supporting turret 42. Fixed to the shaft 88 is a transversely extending arm 90 and secured to the distal end of the arm is a strand control or strand hold-off means or member 92 shown in FIGS. 1 and 2.

The strand control member is fashioned with tapered portions 94, **94*a*, 94*b* and 94*c*, the junctures of the portions forming circular shoulders or abutments 96, the juncture of the rearmost tapered portion 94 with the arm 90 being a circular ledge or abutment 97 on the arm 90**. Thus, an abutment or ledge is provided for engagement with each of the strands.

The shaft 88 is reciprocated at the time of indexing the turret 42 and is adapted to be rotated through a partial revolution from the position shown in full lines in FIG. 2 to the position shown in broken lines to effect disengagement of the strands with the strand oscillators 86 at the completion of the wound packages at the winding station.

In effecting transfer of the strands from the completed packages onto the empty collectors on the other collet, it is desirable that each strand be transferred to an end region of the forming tube or collector in order to render the strand end readily accessible for future processing. The member 92 functions to disengage the strands from the oscillators 86 by partial rotation of the shaft 88 and the arm 90, the shaft 88 and member 92 being reciprocated just prior to an indexing operation of the turret 42 to engage the member 92 with the strands.

Just prior to indexing the turret 42, rotation of the standby collet 56 bearing empty forming tubes is automatically initiated to bring the peripheral speed of the empty forming tubes on the collet 56 to approximately the linear speed of the strands. The shaft 88 and the arm 90 are rotated from the position shown in full lines in FIG. 2 to the position shown in broken lines, the shaft 88 disengaging the strands from the oscillators 84, this movement engaging the tapered sections on member 92 with the strands.

The shaft 88 and member 92 are then moved lengthwise in a right-hand direction, as viewed in FIG. 1, by means contained within the winding machine housing 38 to engage the several ledges 96 and the ledge 97 with the respective strands to position the moving strands at the end regions of the respective packages. The turret 42 is then automatically indexed through 180° to move the collet **56*a* and the completed strand packages 72 thereon away from the winding station and simultaneously move the collet 56** containing empty forming tubes or collectors to the winding station.

Disposed between the collets 56 and **56*a* and mounted by the turret plate 44 is a baffle means 100. The baffle means 100 is inclusive of sections or members 101 of sheet metal provided with slots 102 to provide clearance for the strands as they are transferred from completed packages onto the empty forming tubes on the other collet. Each of the slots 102 is defined by pairs of comparatively thin V-shaped sheet metal plates or members 103 welded to the edge regions of the portions 101 at the slots 102, the plates 103** providing reinforcement for the baffle means at the regions of the slots.

Welded to the inner end of the baffle members 101 is a plate or member 104 which is welded or otherwise secured to the plate 44 of the turret construction 42. During indexing movement of the turret or head 42, the collet bearing the completed packages is rapidly reduced in speed and the other collet supporting empty forming tubes is rotated whereby the peripheral speed of the empty forming tubes is substantially equal to the linear speed of the strands. The controls for the collets are conventional and are described in the patent to Smith U.S. Pat. No. 3,109,602.

As the speed of the completed packages is reduced, slack regions in the strands occur between the empty sleeves on the collet 56 and the completed packages 72 on the other collet **56*a* which have moved away from the winding station. The slack regions of the strands are adjacent the peripheries of the end regions of the empty forming tubes on the collet 56** and allow the strands to adhere or "lick" to the peripheries of the empty sleeves whereby initial winding of the strands on the empty sleeves is begun.

The strands adhering to the empty sleeves are snubbed by succeeding convolutions or wraps of strand setting up tension in the regions of the strands between the completed strand packages and the initial strands on the empty sleeves causing the strands to break or fracture between the completed packages and the empty forming tubes thus freeing the completed packages which are brought to rest by braking forces applied to the collet driving motor as described in U.S. Pat. No. 3,109,602.

The arrangement is particularly adapted for winding three or more packages of strand simultaneously. As shown in FIG. 1, strands are wound on four separate forming tubes on a collet. Conventional forming tubes are usually of a length of eleven inches or more and when more than two forming tubes are mounted on a collet in end-to-end relation, an operator encounters difficulties in removing the rearmost forming tubes bearing completed packages from a collet and especially where several winding machines are arranged in a row with the winding machines in closely spaced relation.

The invention is inclusive of a method and means for facilitating the removal of or stripping strand packages from a collet irrespective of the number of packages on the collet. In the embodiment illustrated in FIGS. 1 through 7, a package removing or stripping means is associated with or mounted by the baffle means 100 to facilitate the removal of strand packages from a collet.

The sheet metal members 101 of the baffle means 100 extend substantially full length of the collet and have central longitudinal planar regions or portions 106 in parallel relation with a spacer member or means 108 disposed between the planar portions 106 as shown in FIG. 5. Disposed adjacent the exterior surface of one portion 106 is a pair of longitudinally extending members, ways or bars 110, and disposed adjacent the exterior surface of the other portion 106 is a pair of members, ways or bars 112.

The bars 110 are provided with longitudinally extending flanges 114 which, with the adjacent central portion 106, provide a slot 116 of T-shaped cross section. The bars 112 are provided with longitudinally extending flanges 118 which, with the adjacent central portion 106, provide a slot 120 of T-shaped cross section, the T-shaped slots being in parallelism with the axes of the collets. The pairs of bars 110 and 112 are secured in assembled relation with the components 101 of the baffle means and the spacer 108 by screws 122, as shown in FIG. 5.

The T-shaped slot 116 accommodates a bar or member 126 of T-shaped cross section, shown in FIG. 6, the bar being slidable in the slot 116 and extending substantially full length of the baffle means. The T-shaped slot 120 accommodates a bar or member 128 of T-shaped cross section, identical with the bar 126, the bar 128 being slidable in the slot 120 and extending substantially full length of the baffle means. The bars 126 and 128 are shown in FIG. 4.

Each of the bars 126 and 128 is provided with a manipulating means or handle member for effecting slidable movement of the bars 126 and 128 relative to the baffle means. A handle member 130, shown in FIGS. 1 through 4 and 6, is secured to the forward end region of the bar 126 by screws 132 and a similar handle member **130*a*, shown in FIGS. 2, 3 and 4, is secured to the forward end of the bar 128 by screws 132**.

Mounted on the respective inner ends of the collets 56 and **56*a* are members 136 and 136*a*, the members being secured by welding or other suitable means. Loosely or slidably supported upon the collet 56 is a means, annular member, component or annulus 138 of L-shaped cross section as shown in FIG. 3. A similar member 138*a* is loosely or slidably supported on the collet 56*a*. Each of the annular members 138 and 138*a* has a sliding clearance with the supporting collet but the annular members 138 and 138***a* may rotate with the collets.

When forming tubes or collectors are telescoped onto a collet, the rearmost forming tube abuts the annular member 138 or 138*a* and the members 138 and 138*a* abut the members 136 and 136*a* mounted at the ends of the respective collets. The members 136 and 136*a* and the annular members 138 and 138*a* provide abutment or positioning means for the forming tubes telescoped onto the mandrels, the forming tubes being in end-to-end abutting relation.

As shown in FIGS. 3, 4, 6 and 7, a plate or member 142 is secured to the slidable bar 126 by means of screws 144, a spacer block 145 being disposed between the member 142 and the bar 126. Welded to the member 142 is an annular element 148 of a size to engage the outwardly extending flange portion of the annular member 138 but of an internal diameter to have running clearance with the portion of member 138 extending rearwardly toward the turret plate 44.

The annular element 148 is nonrotatable and is positioned with respect to the outwardly extending flange portion of the annular member 138 so that during rotation of the mandrel 56 and the annular member 138, the annular element 148 is not in engagement therewith.

Secured to the slidable bar 128, shown in FIG. 4, is a similar member 142*a* to which is welded or otherwise secured an annular element 148*a.* The annular element 148*a* does not rotate but is adapted for engagement with the annular member 138*a* which has sliding clearance on the mandrel 56*a.* During rotation of the collet 56*a* in winding strands on forming tubes at the winding station, the annular element 148*a* is out of engagement with the annular member 138*a* as the bar 128 is retracted to its rearmost position with respect to the collet.

When a package winding cycle is completed, the turret 44 is indexed to move the collet 56*a* and completed packages to a standby position or position of rest diametrically opposite the winding station. The motor driving the collet 56*a* bearing completed strand packages is de-energized and eventually the collet 56*a* ceases rotation. The operator then grasps the manipulating means or handle member 130*a* and slides the bar 128 lengthwise relative to the collet. The nonrotatable annular element 148*a* is thereby engaged with the annular member 138*a* which is in abutting relation with the rearmost forming tube containing a wound package.

The forward sliding movement of the bar 128 lengthwise of the collet strips or removes all of the wound packages of strand and their supporting forming tubes from the collet. As the winding machine is of the automatic type, winding of the strands on the forming tubes supported by the collet 56 continues without interruption.

After the operator strips the formed packages from the collet 56*a,* the operator retracts the slidable bar 128 to its rearmost position and telescopes strand-free or empty forming tubes onto the collet 56*a,* the rearmost tube engaging and moving the annular member 138*a* to its rearmost position adjacent the retracted ring 148*a.* Winding continues to form packages on the forming tubes mounted on the collet 56 at the winding station, and the above-described cycle of operations is repeated when the packages being wound are completed.

Figure 9:
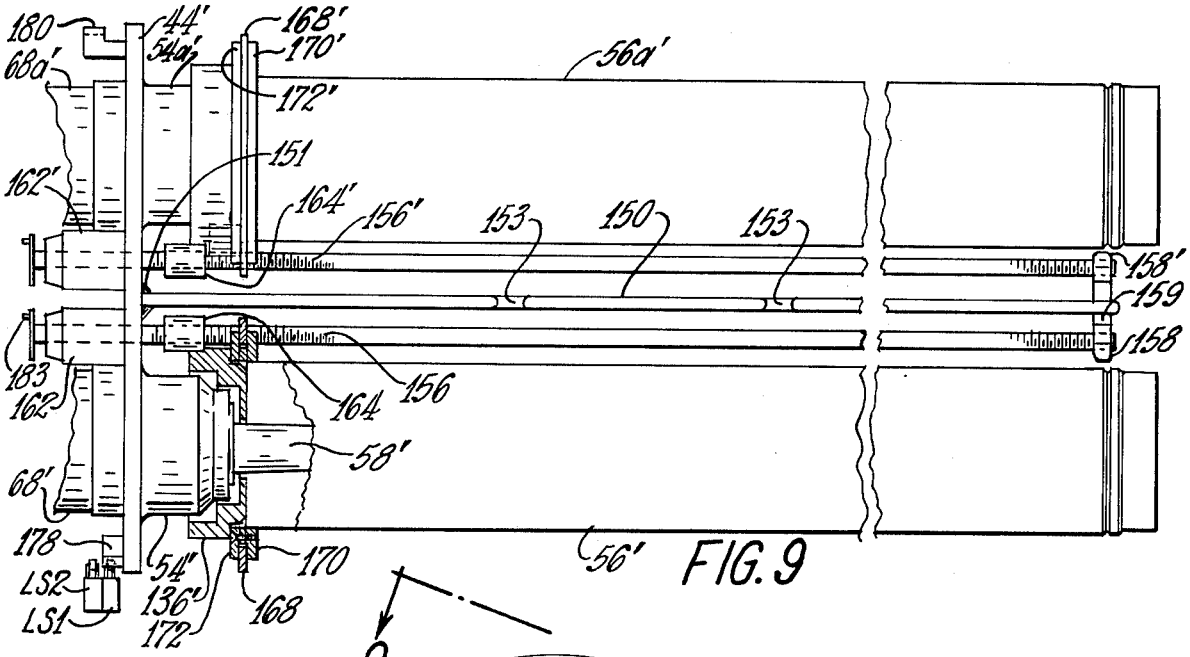
FIG. 9 is a plan view partly in section of the arrangement shown in FIG. 8, the view being taken on the line 9—9 of FIG. 8.
Figure 10:
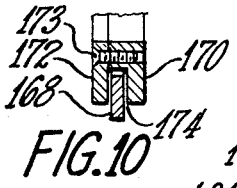
FIG. 10 is a fragmentary sectional view of a component of the apparatus shown in FIG. 9.
Figure 8:
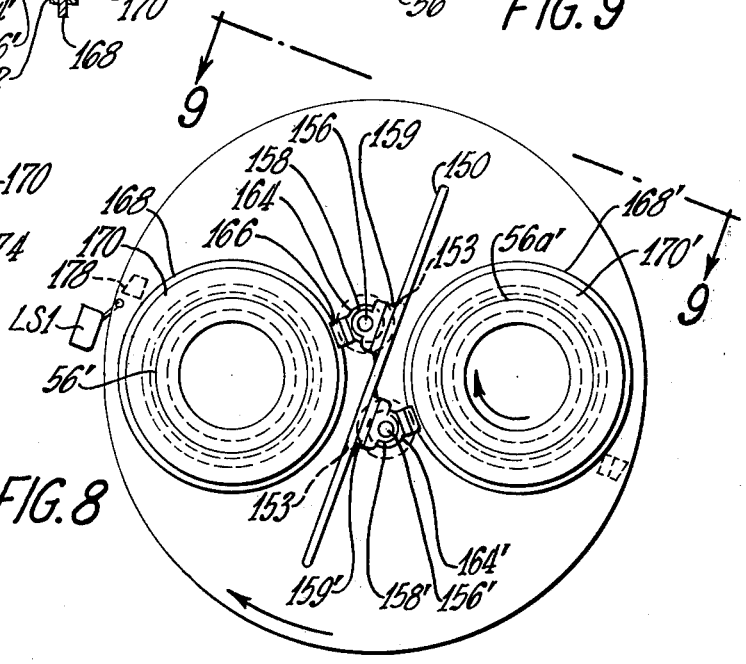
FIG. 8 is an end view of the winding collets in association with a form of automatic package removing means of the invention.
Figure 11:
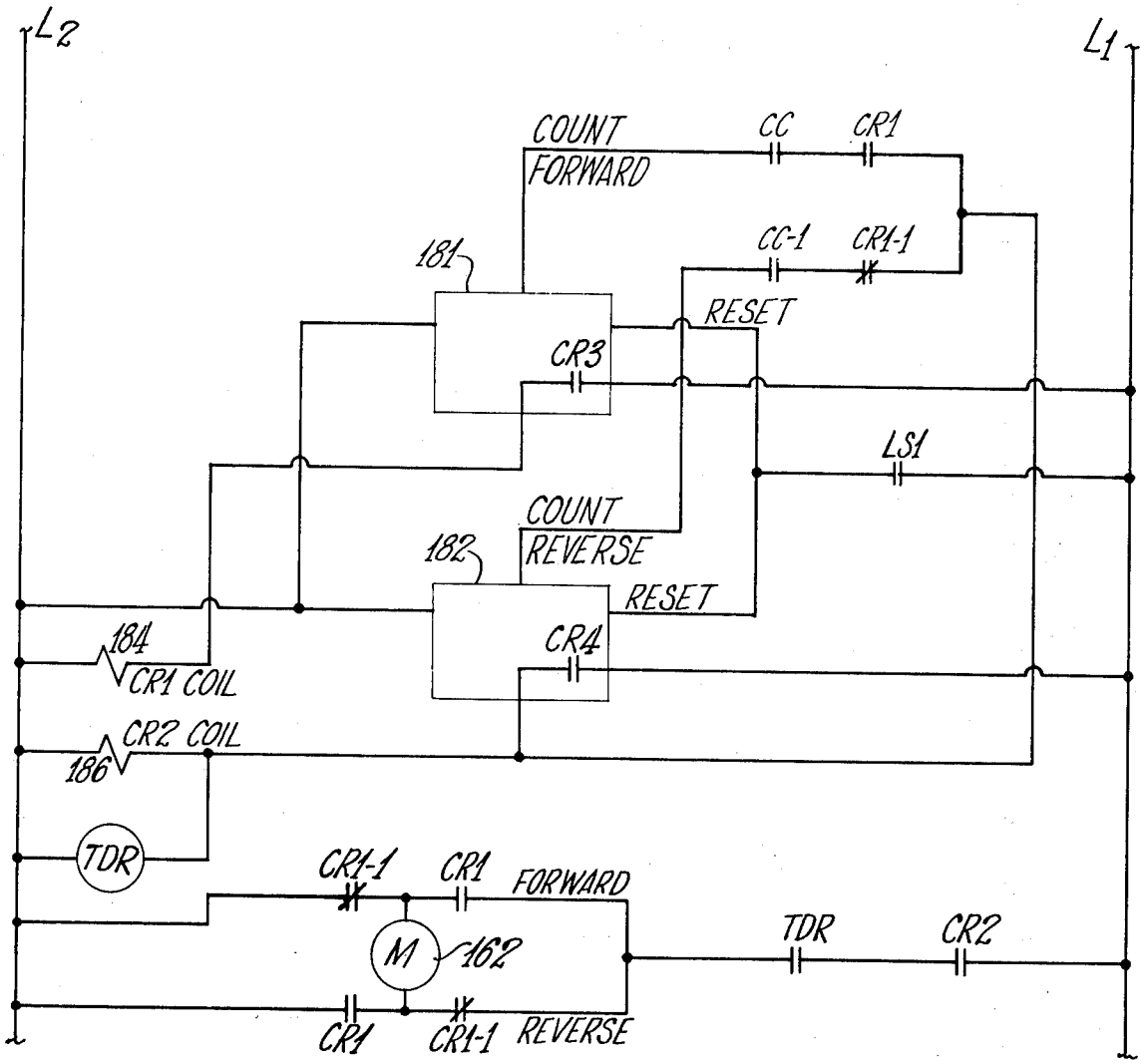
FIG. 11 is a schematic diagram of the circuit for the electrical components actuating and controlling the package removing means of FIGS. 8 through 10.

FIGS. 8 through 10 illustrate an automatically operable arrangement or means for removing or stripping strand packages from a collet or mandrel of a winding machine at the completion of a winding cycle. FIG. 11 illustrates a circuit for the electrical components for effecting the automatic operation of the package removing means. The collets or mandrels 56' and 56*a'* are of the same construction as the collets or mandrels 56 and 56*a* and are mounted in the same manner as hereinbefore described.

Each collet is mounted on a spindle 58' journaled in bearings contained in bosses 54' and 54*a'* mounted by a turret plate or member 44'. The collets are adapted to be rotated by motors 68' and 68*a'*. The baffle means disposed between the collets or mandrels comprises a planar metal member 150 welded as at 151 to the turret plate or member 44'. The baffle means or member 150 is provided with slots 153 to accommodate the strands during transfer of the strands from wound packages onto forming tubes on the other collet.

The arrangement illustrated in FIGS. 8 through 10 comprises an automatically operable package stripping or removing means associated with each of the collets. The package removing means associated with the collet 56' is inclusive of a threaded shaft or lead screw 156, the forward end region of the shaft being unthreaded and journaled in a journal block 158 mounted on a member or spacer 159 which is welded or otherwise secured to the baffle member 150 as shown in FIG. 8.

The shaft 156 is adapted to be rotated by an electrically energizable reversible motor 162. The axis of the threaded shaft 156 is parallel with the axis of the collet 56'. Mounted on the shaft 156 is a member, nut or carriage 164 having a threaded bore receiving the threads of the shaft 156. As shown in FIG. 8, the nut or carriage 164 has a laterally extending projection 166 to which is welded or otherwise secured an annular element or ring 168 of the same character as the element 148 hereinbefore described.

Mounted for sliding movement on the collet 56' is an annular member or annulus 170 to which is secured a second annular member or circular member 172 by screws 173 as shown in FIG. 10. The annular member 170 has a peripheral recess 174, the recess accommodating the annular element or ring 168 carried by the nut 164. It will be noted in FIG. 10 that the recess 174 is of a width greater than the width of the ring or annular element 168 whereby the annular unit comprising annular members or rings 170 and 172 may rotate with the collet 56' without engaging the annular element or ring 168 carried by the nut or carriage 164.

Secured to the rearmost end of the collet is a member 136' which forms an abutment for the ring 172, the annular member 170 providing an abutment or positioning means for the rearmost forming tube telescoped onto the collet 56'. Rotation of the threaded shaft 156 in one direction causes the nut or carriage 164 and annular element 168 to move in a right-hand direction, as viewed in FIG. 9, the element 168 engaging ring 170 to remove or strip the packages of strands on the forming tubes from the collet 56'.

Rotation of the shaft 156 in the opposite direction retracts the nut or carriage 164, the annular element 168, annular members 170 and 172 to the extreme left-hand position, as viewed in FIG. 9, preparatory to the telescoping of empty forming tubes onto the collet by the operator for a succeeding winding cycle.

Associated with the collet 56*a'* is a package removing means identical with that described above for the collet 56'. The package removing means for the collet 56*a'* is inclusive of a threaded shaft 156' journaled at its forward end region in a journal block 158' mounted through a spacer 159' on the baffle means or member 150.

Mounted on the threaded shaft 156' is a nut or carriage 164' to which is secured an annular element 168'. Slidably received on the collet 56a' is a unit construction comprising rings 170' and 172', the ring 170' having a recess to loosely accommodate the annular element 168'. The threaded shaft 156' is adapted to be rotated by a reversible motor 162'. The package removing means for the collet 56a' operates in the same manner as the package removing means associated with the collet 56'. As shown in FIGS. 8 and 9, the shafts 156 and 156' are mounted on head 44' and are positioned within the central zone defined by the external planes tangent in common to the peripheries of immediately adjacent collets, excluding the tubularly-shaped spaces occupied by the packages on the collets. External planes tangent in common are those planes tangent to both of immediately adjacent collets, parallel to the straight line between their centers, and adjacent the perimeter of the circumscribed set of collets.

The circuit and electrical components for actuating and controlling the package removing or stripping means associated with the collet 56' are illustrated in FIG. 11. The circuit and electrical components for actuating and controlling the package removing or stripping means associated with the collet 56a' are substantially the same as the circuit and electrical components illustrated in FIG. 11.

Referring to FIGS. 8 and 9, a limit switch LS1 is mounted on the winding machine housing adjacent the indexible turret plate 44'. Mounted on the indexible plate 44' is an actuator 178 for the limit switch LS1. As the turret is indexed to move the collet 56' bearing completed packages of strands to its standby position or position of rest, that is, the position shown in FIG. 8, the limit switch LS1 is momentarily actuated by the actuator 178 as the turret approaches the standby position to initiate operation of the automatic means for removing strand packages from the collet 56'. The limit switch LS1 is not in the actuated state when the turret is at rest with collet 56' in the standby position.

As shown in FIG. 9, a second limit switch LS2 is mounted by the winding machine housing adjacent the indexible plate 44'. The plate 44' is provided with a second actuator 180 which, when the turret is indexed, momentarily actuates the limit switch LS2 to initiate the automatic package removing means for stripping or removing packages from the other collet 56a'.

The circuit diagram of FIG. 11 includes the limit switch LS1 for initiating operation of components for stripping packages from the collet 56'. A circuit arrangement of the same character, but substituting limit switch LS2 for LS1, is provided for initiating operation of components for stripping packages from the collet 56a' when the latter is indexed 180° from its position shown in FIG. 8, the limit switch LS2 being momentarily actuated by the actuator 180 as the collet 56a' approaches the standby or position of rest at which the strand packages are removed. Similarly LS2 is not in the actuated state when the turret is in the standby or package removing position.

Referring to the circuit diagram of FIG. 11, L1 and L2 indicate conductors of an electric current supply. The limit switch LS1 is normally open. The circuit includes two counters 181 and 182 of identical construction for counting the revolutions of the shaft 156 in one direction and counting the revolutions of the shaft in the opposite direction. The revolution counters 181 and 182 are of conventional construction, such as an impulse counter produced by Landis and Gyr of Elmsford, N.Y., marketed under the trade name "SODECO" and identified as Model 2TCeF4PE. The counters 181 and 182 are of the adjustable type and are adapted to count backwards from any preset number. The counters are actuated through a suitable means associated with the shaft 156 such as a projection 183, shown in FIG. 9, on the shaft of motor 162.

The circuit for the counter 181 includes forward contacts CC and the circuit for the counter 182 includes reverse contacts CC1, the counters being set into operation through the closing of limit switch LS1. The motor 162 for rotating the shaft 156 is of the reversible type and is controlled by contact relays CR1 for initiating rotation of the motor in one direction to remove packages from the collet and contacts CR1-1 for reversing the direction of the motor to retract the package stripping means to its initial position. Contact relays CR1 have an energizing coil 184 and contact relay CR2 has an energizing coil 186.

The circuit includes an adjustable time delay relay TDR which may be timed to delay operation of the package removing means until the collet bearing completed packages at the standby position ceases rotation.

The functioning of the circuit shown in FIG. 11 in stripping strand packages from the collet 56' is as follows: During indexing movement of the turret plate 44', the collet 56' bearing completed strand packages is moved to the standby or package removing position, illustrated in FIG. 8, and the actuator 178 momentarily actuates limit switch LS1 briefly closing the switch.

Closing switch LS1 energizes the time delay relay TDR, coil 184 of the contact relay CR1 by means of counter 181, the coil 186 of the contact relay CR2 by means of counter 182, and resets the counters which are preset to the number of revolutions for the shaft 156 occurring during the period of removing the strand packages from the collet at the package removing station. Both counters are preset to the number of revolutions for the shaft 156 during a package removing cycle, for example, 100 revolutions.

Thus, at the start of a package removing cycle momentarily closing limit switch LS1 resets counters 181 and 182 to the preset number and effectuates closing contact relays CR3 and CR4 respectively. Closing contact relay CR3 energizes coil 184 thereby closing contact relays CR1 and opening contact relays CR1-1. Closing contact relay CR4 energizes coil 186 thereby closing contact relay CR2. Closing contact relay CR4 also energizes the time delay relay TDR. After the predetermined time expires for which the time delay relay has been set, contact relay TDR closes completing a circuit through motor 162 causing rotation of the motor and shaft 156 in a direction stripping or removing the packages of strand from the collet 56'. Note that the time delay of the time delay relay is at least of sufficient duration such that the turret plate 44 is completely at rest in the standby or package removal position.

The closed contact relays CR4 and CR1 establish a circuit to the forward contacts CC of counter 181 and as the motor 162 rotates in the forward direction the contacts CC are pulsed by a suitable means such as projection 183 whereby counter 181 counts down to zero. During this period counter 182 remains set at its preset number and contact relay CR4 remains closed. When counter 181 reaches zero, contact relay CR3 opens thereby de-energizing coil 184. That is, relay CR1 remains energized until the counter 181 has counted to the preset number, that being the number of revolutions of shaft 156 to effect stripping of the strand packages from collet 56'. When coil 184 is de-energized contact relays CR1 open and contact relays CR1-1 close whereby motor 162 reverses rotation and counter 182 counts down from the preset number to zero as contacts CC-1 are pulsed by a suitable means such as projection 183.

During this period, the shaft 156 is rotated in a reverse direction returning the carriage 164 to its retracted position. When the counter 182 reaches zero position, contacts CR4 open thereby de-energizing coil 186 and the time delay relay TDR thereby opening contacts CR2 and TDR respectively whereby the rotation of motor 162 is stopped. The circuit is thus conditioned for the next operation of removing strand packages from the collet 56'.

The circuit for removing packages from the collet **56*a'* functions in the same manner but the circuit is established by the momentary closing of the limit switch LS2. The limit switch LS2 is actuated by the actuator 180 carried by the plate 44' which actuates limit switch LS2 as the collet 56*a'* bearing completed packages approaches a standby position at which the strand packages are removed by the package removing arrangement associated with the collet 56*a'***.

Through the arrangement illustrated in FIGS. 8 through 11, the packages of strand on the forming tubes are successively and automatically removed from each of the collets when a collet bearing completed packages is moved to a standby position or position of rest.

It is apparent that, within the scope of the invention, modifications and different arrangements may be made other than as herein disclosed, and the present disclosure is illustrative merely, the invention comprehending all variations thereof.

We claim:

1. Apparatus comprising, a frame, an indexible head mounted by the frame, collets mounted by the head and movable by said head to a package winding position and to a package removing position, means for rotating the collets at the winding station for winding a strand on one of the collets to form a package of strand, baffle means mounted by said head and disposed adjacent the collets, means for indexing said head at the completion of the package at the winding station to move the collet bearing the completed package to the package removing station, and means mounted by the baffle means for moving the package along the length of the collet at the package removing station.

2. Apparatus of the character disclosed, in combination, a frame, a head rotatably mounted by the frame, winding collets mounted by the head, each of the winding collets adapted to support a plurality of tubular collectors in end-to-end relation, means individual to each collet for rotating the collets and collectors for winding strands of glass fibers at a winding station on the collectors forming packages of strand, said head being indexible to move a collet from the winding station to a package removing station, baffle means mounted by said head and disposed adjacent the collets, annular means surrounding each collet and disposed adjacent the rearmost collector, and means mounted by the baffle means for moving the annular means lengthwise of the collet at the completion of the wound packages for removing the packages from the collet.

3. The combination according to claim 2 wherein the means for moving the annular means lengthwise of the collet includes a bar disposed adjacent each side of the baffle means and slidable lengthwise of the baffle means, an element carried by each bar and disposed adjacent the annular means on a collet, and handle means mounted by each bar for moving the bar lengthwise to remove the completed packages of strand from the collectors.

4. Apparatus of the character disclosed, in combination, a frame, a head rotatably mounted on the frame, a plurality of winding collets mounted by said head, driving means individual to each collet for rotating the same, each of said collets adapted to receive a plurality of tubular collectors in end-to-end relation upon which strands of fibers are wound to form packages, said head being indexible to successively move a collet and collectors thereon to a winding station at which at least one strand is wound on each collector and concomitantly move a second collet and collectors filled with strand to a package removing station, baffle means disposed adjacent the collets mounted by said indexible head, annular means surrounding each collet and disposed adjacent the rearmost collector, a journally supported threaded shaft extending lengthwise adjacent each of the winding collets, said shafts being mounted on the head and disposed within the central zone defined by the exterior planes tangent in common to the peripheries of the immediately adjacent collets and excluding the spaces occupied by the packages on the collets, a carriage mounted on each of said shafts, each of said carriages having means adapted for engagement with one of the annular means surrounding a collet, and means individual to each shaft for rotating the shaft to move the carriage lengthwise of the adjacent collet for removing wound packages from the collet at the package removing station.

5. Apparatus for winding strand comprising:

a frame;

a head journaled on the frame;

a plurality of collets rotatably mounted on the head, the head being indexible to move each of the collets from a winding station to a package removing station;

means for rotating each of the collets at the winding station to form a package of wound strand;

a threaded shaft rotatably mounted on the head between and lengthwise of the collets, the threaded shaft being disposed within the central zone defined by the planes tangent in common to the peripheries of the immediately adjacent collets and excluding the spaces occupied by the packages on the collets;

a carriage engaging the threads of the shaft, the carriage being adapted to engage the package on the collet at the package removing station; and means for rotating the shaft to move the carriage lengthwise of the collet at the package removal station to move the package on such collet along the length thereof.

6. Apparatus for collecting strand comprising;

a frame;

a head rotatably mounted on the frame;

a plurality of collets rotatably mounted on the head;

means for rotating the collets to wind a strand around the collets; and means individually associated with each of the collets for moving a package of strand lengthwise along each of the collets, such means being mounted on the head and moved with the collets during rotation of the head and being disposed within the central zone defined by the exterior planes tangent in common to the peripheries of the immediately adjacent collets and excluding the spaces occupied by the packages on the collets, Apparatus for winding strand comprising;

frame;

head rotatably mounted on the frame;

plurality of collets rotatably mounted on the head, each of the collets being adapted to receive at least one tubular collector;

plurality of threaded shafts rotatably mounted on the head, each of the shafts being individually associated with one of the collets and disposed lengthwise thereto, the shafts being disposed within the central zone defined by the exterior planes tangent in common to the peripheries of the immediately adjacent collets and excluding the spaces occupied by the packages on the collets, means for rotating the head to successively move each of the collets and associated threaded shafts to a winding station and a package removal station;

means for rotating each of the collets to wind a strand around the collector thereon at the winding station to form a package thereon;

an annular means surrounding each of the collets being adapted to engage the package thereon;

a carriage mounted on each of the shafts, each of the carriages having means adapted for engagement with one of the annular means surrounding each of the collets; and means for rotating each of the shafts to move the carriage and annular means lengthwise of the collet associated therewith to move the package thereon lengthwise of such collet.

8. The apparatus of claim 7 wherein the annular means engages an end of the tubular collector.

9. The apparatus of claim 7 wherein the annular means abuttingly engages a member on the end of the collet adjacent the head for locating the packages on the collet at the winding station.

* * * * *